United States Patent [19]

Jeppson

[11] 4,175,885

[45] Nov. 27, 1979

[54] METHODS FOR SEALING AND RESEALING CONCRETE USING MICROWAVE ENERGY

[75] Inventor: Morris R. Jeppson, Carmel, Calif.

[73] Assignees: Giselle V. Laurmann, Carmel, Calif.; Richard R. Blurton; Claire M. Blurton, both of Incline Village, Nev. ; part interest to each

[21] Appl. No.: 860,158

[22] Filed: Dec. 14, 1977

Related U.S. Application Data

[63] Continuation-in-part of Ser. No. 756,365, Jan. 3, 1977.

[51] Int. Cl.[2] ..... E01C 7/06

[52] U.S. Cl. ..... 404/77; 404/31; 404/95

[58] Field of Search ..... 404/31, 28, 77, 27, 404/95, 94, 72, 79

[56] References Cited

U.S. PATENT DOCUMENTS

| | | | |
|---|---|---|---|
| 1,247,271 | 11/1917 | Hines | 404/77 |
| 1,593,320 | 7/1926 | Warren | 404/95 |
| 2,044,558 | 6/1936 | Ball | 404/94 X |
| 2,254,463 | 9/1941 | Wells | 404/95 |
| 2,274,517 | 2/1942 | Ashmore | 404/95 X |
| 2,347,233 | 4/1944 | Abernathy | 404/31 X |
| 3,025,773 | 3/1962 | McConnaughay | 404/79 |
| 3,603,221 | 9/1971 | Barton | 404/31 |
| 3,874,366 | 4/1975 | Cutler | 404/95 X |
| 3,970,404 | 7/1976 | Benedetti | 404/77 |

*Primary Examiner*—Nile C. Byers, Jr.
*Attorney, Agent, or Firm*—Phillips, Moore, Weissenberger, Lempio & Majestic

[57] ABSTRACT

Portland cement concrete at a roadbed, bridge deck or the like is quickly and deeply heated and dried by directing microwave energy into the concrete and by applying hot gas to the surface. A layer of thermoplastic sealant is applied to the hot concrete followed by an overlayer of asphaltic concrete having a higher softening temperature than the sealant layer. Compaction then produces a composite pavement which is sealed against water intrusion and which can be quickly, easily and economically resealed and resurfaced at a later time using little or no additional paving materials. Resealing and resurfacing is accomplished by deeply reheating all three layers by microwave irradiation followed by recompaction. If cracking and deterioration are severe, the asphaltic concrete layer may be remixed and rescreeding between the reheating and recompaction steps. Both the initial production of the composite pavement and the restoration processes can be accomplished on a continuous process basis while traveling along the roadbed, bridge deck or the like.

19 Claims, 8 Drawing Figures

Concrete and Aggregates

THERMAL GRADIENTS CHARACTERISTIC OF BRIDGE DECK HEATING METHODS

METHODS FOR SEALING AND RESEALING CONCRETE USING MICROWAVE ENERGY

CROSS-REFERENCE TO RELATED APPLICATION

This application is a continuation-in-part of applicant's copending application Ser. No. 756,365, filed Jan. 3, 1977 and entitled "MICROWAVE METHOD AND APPARATUS FOR REPROCESSING PAVEMENTS."

BACKGROUND OF THE INVENTION

This invention relates to the production, maintenance and resotration of concrete pavements and more particularly to pavements and paving operations involving the overlaying of asphaltic concrete on non-asphaltic concrete.

In this specification and the following claims, the term "cement concrete" will be used to refer to pavements of the kind in which rock particles of various sizes are joined by a binder, such as Portland cement or the like, that does not soften upon being heated to high temperatures. The term "asphaltic concrete" will be used to designate essentially thermoplastic concretes in which rock particles are bound by asphalt or an equivalent substance that can be softened to a liquid or semi-liquid state by being heated and which reharden upon cooling.

Paved highways, roads, bridge decks, aircraft landing runways and the like formed of cement concrete deteriorate after a period of time most notably by developing cracks which tend to enlarge. Slight cracks or incipient cracks may occur initially during the original curing of the concrete. Others may be initiated by thermal expansion and contraction effects or by impacts and uneven pressures from heavy vehicles or other causes. Cracks, including those which are initially very small, tend to enlarge and deepen over a period of time in part from the effects of repeated freezing and thawing of water which accumulates in the cracks.

While this progressive cracking is undesirable in any concrete pavement, it is a particularly serious problem in connection with concretes which contain steel reinforcing elements or the like. When cracks progress to the point where water may reach the reinforcement elements, rusting can greatly weaken the load-resisting capability of the concrete. Loss of structural strength from rusting of reinforcement elements is a very serious problem in bridge decks, although the problem is not limited to that particular context.

Many of the extensive conrete roadways and bridge decks which have been built in the recent past in the United States of America and elsewhere are exhibiting serious deterioration from cracking and surface irregularities and will eventually have to be replaced at great cost and effort unless better techniques for restoration and maintenance are developed.

Using known methods, concrete deterioration can be inhibited to a limited extent and worn concrete can be temporarily resealed by applying any of a variety of hardenable liquid sealants to the surface to inhibit water intrusion into cracks. The effectiveness of this process as heretofore practiced is very limited, particularly if the pavement is subjected to heavy use. Such sealants apparently do not penetrate as deeply and completely into cracks and other openings as would be desirable and the sealant itself may deteriorate rapidly.

Attempts have also been made to cast a dispersion of small wax beads within the concrete with the intention that after some deterioration has occurred, the concrete may be heated to liquefy the wax and that the wax will then flow into the interior openings of the concrete and reharden and reseal the pavement. This also has not proved satisfactory possibly because of the limited mobility of the liquefied wax or possibly because of the difficulties of deeply heating pavement with conventional heating methods.

Probably the most common prior method for addressing the problem discussed above has been to reseal and resurface the deteriorated cement concrete pavement by applying an overlayer of asphaltic concrete. While this accomplishes the desired result for a limited period of time, asphaltic concrete is itself subject to cracking and general deterioration with the result tha the problem soon reappears. Further resealing and resurfacing of such a composite pavement at that point, using known techniques, is a very costly and timeconsuming process at best.

SUMMARY OF THE INVENTION

The present invention provides a resealable concrete pavement and methods for the production and periodic resealing and resurfacing of pavement utilizing microwave energy. While the invention is applicable to the installation of new pavement at roadways, bridge decks, aircraft runways or the like, it is also highly valuable in connection with the restoration and maintenance of existing cement concrete pavements which may be exhibiting deterioration from cracking and other causes.

A composite pavement produced in accordance with the present invention may have a base layer of cement concrete and an intermediate layer of thermoplastic sealant, portions of which may extend down into any cracks or surface irregularities that may be present in the base layer. An overlayer of asphaltic concrete or the like is provided which preferably has a softening temperature greater than that of the sealant layer.

The composite pavement is formed by directing microwave energy into either newly cured or partially deteriorated pre-existing concrete pavement to quickly and deeply heat and dry the base layer concrete. Heating and drying may be facilitated by also applying hot gas to the surface of the base layer. An intermediate layer of thermoplastic sealant is then applied to the base layer and readily penetrates down into such cracks as may be present owing to the deeply heated state of the base layer produced by the microwave irradiation. An overlayer of asphaltic concrete is then applied and the composite pavement is compacted. The product is a composite pavement which is sealed against water intrusion and, moreover, is easily and efficiently resealable at intervals thereafter.

At such time as the composite pavement itself exhibits significant deterioration from cracking or other causes, resealing and resurfacing is quickly, easily and economically accomplished with little or no additional materials by then deeply heating all three layers of the composite pavement by microwave radiation followed by recompaction. The sealant layer, which preferably has a softening temperature lower than that of the asphaltic concrete overlayer, quickly becomes liquid or semi-liquid as a result of the microwave radiation and again penetrates into cracks and voids in the reheated base layer. In instances where deterioration is sufficiently severe, recycling of the asphaltic concrete layer is readily accomplished by remixing and rescreeding the decomposed asphaltic concrete between the microwave irradiation step and the recompaction step.

While both the initial production process and the resealing and resurfacing processes can be performed on a batch or fixed area basis, it is readily possible and advantageous to perform either method while traveling continuously along a roadbed or the like.

Accordingly, it is an object of the invention to provide more effective and economical methods for the maintenance of concrete pavements.

It is another object of the invention to provide more practical and effective methods for sealing concrete pavements, including old, deteriorated pavements as well as new pavements.

It is still another object of the invention to provide methods for inhibiting structural weakening of reinforced concrete at bridge decks, roadways and the like.

It is still another object of the invention to provide for production of a composite concrete pavement which may be readily resealed and resurfaced at periodic intervals and to provide efficient and economical methods for accomplishing the resealing and resurfacing.

The invention, together with further objects and advantages thereof, will be better understood by reference to the following description of preferred embodiments taken in conjunction with the accompanying drawings.

DESCRIPTION OF PREFERRED EMBODIMENTS

Figure 1:
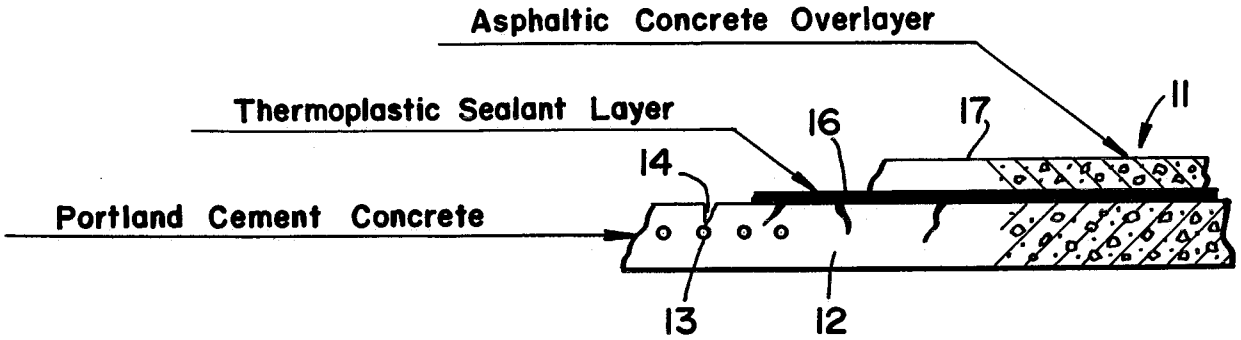
FIG. 1 is a vertical section view of a resealable composite concrete pavement produced in accordance with the invention.

Referring initially to FIG. 1 of the drawings, a resealable composite pavement 11 produced in accordance with the invention may have a laminated structure including a base layer 12 formed of non-asphaltic cement concrete. In this particular example base layer 12 is a bridge deck having internal reinforcement members such as steel rebars 13 although the method is also applicable to road pavements or other concrete paving which may or may not have reinforcement. The base layer 12 in this particular example is a somewhat deteriorated bridge deck exhibiting irregular cracks 14 produced over a period of time by the freezing and thawing of accumulated water and other causes as previously discussed. While the base layer 12 need not necessarily be reinforced concrete nor need it be deteriorated used concrete pavement, this particular form of base layer 12 is described in the present example since the structural weakening of a bridge deck as a result of concrete cracking and subsequent rusting of rebars 13 presents particularly serious problems. The base layer 13 may, alternately, be freshly cast concrete which is immediately converted to a composite pavement 11 in order to facilitate future resealing and restoration operations.

The composite pavement 11 has an intermediate or sealant layer 16, disposed over the base layer 12, which is formed of thermoplastic water-impervious material of the type which becomes liquid or semi-liquid upon being heated above a softening temperature characteristic of the particular material. The thermoplastic sealant layer 16 may for example be formed of asphalt or other known materials, such as sulfur or polyethylene, having similar properties. The thermoplastic material of the sealant layer 16 extends downward from the surface of the base layer 12 into such cracks 14 or ruts, pits and the like which may be present in the base layer.

The resealable composite pavement 11 further includes an overlayer 17 of asphaltic concrete formed of rock aggregates bound together by asphalt binder or the like. Such concretes may be decomposed by heating to a temperature at which the binder softens or liquefies. In order to facilitate the later resealing operations to be hereinafter described, which involves softening or liquefaction of the thermoplastic sealant layer 16 by microwave heating of the composite pavement, it is preferable that the asphaltic concrete layer 17 employ an asphalt binder or the like having a softening temperature higher than that of the material of the sealant layer 16.

In some prior methods for overlaying asphaltic concrete on non-asphaltic concrete a water-impervious plastic sheet has been disposed between the two concrete layers. Such plastic sheeting may be included in the present composite pavement if desired but, if used at all, it should be situated between the sealant layer 16 and the asphalt concrete overlayer 17 rather than between the sealant layer and the base layer 12.

The vertical thickness of the cement concrete base layer 12 may vary widely as determined in the known manner by the anticipated loads on the concrete. In instances where the base layer 12 is old deteriorated pavement the base layer has a pre-existing thickness established when the concrete was originally laid down. The thermoplastic sealant layer 16 may typically be applied in amounts ranging from about 0.2 gal./yd.$^2$ (1 liter/m$^2$) to about 1 gal./yd.$^2$ (5 liters/m$^2$) although such amounts should not be considered as limitative of the invention. The asphaltic concrete overlayer 17 will normally have a vertical thickness in the range from about 1 inch to 3.5 inches (2 cm to 9 cm), although special circumstances may dictate other thicknesses.

Figure 2:
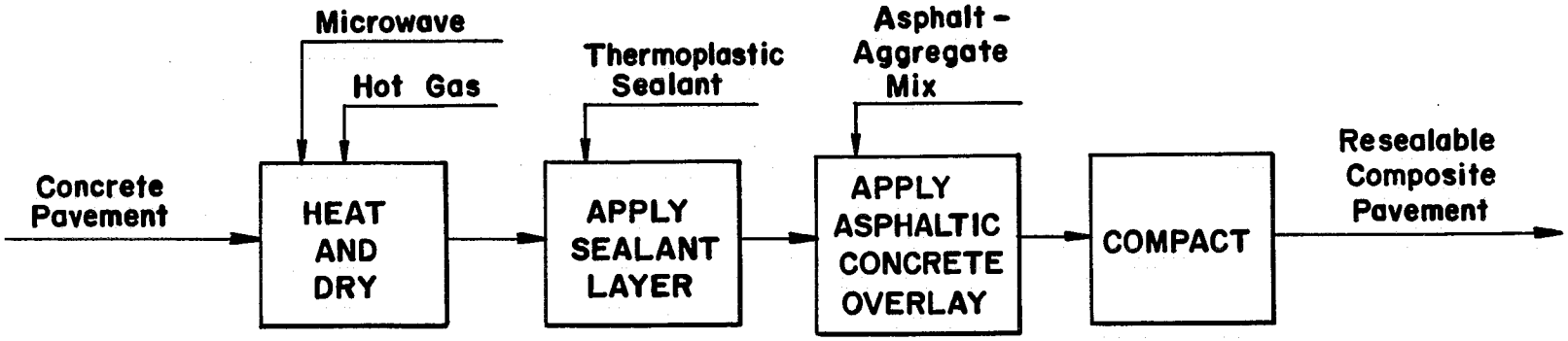
FIG. 2 is a schematic flow sheet illustrating steps in a method for sealing concrete pavement and for producing a composite pavement of the form depicted in FIG. 1.

A sealed and resealable composite pavement 11 of the form discussed above may be produced by the sequence of steps depicted in FIG. 2. The starting point for preparation of the composite pavement is a pre-existing cement concrete pavement which may be either newly formed in the conventional manner or may be a partially deteriorated old cement concrete pavement which is to be sealed and resurfaced.

Prior to application of the layer of thermoplastic sealant material to the base layer of cement concrete, the cement concrete is heated deeply preferably to a depth at least equal to the maximum depth to which cracks in the concrete may extend. Where the sealant layer material is asphalt or a substance having a comparable melting point, the base layer concrete should be heated to temperatures in the range from about 170° F. to 284° F. (77° C. to 140° C.). Except in arid geographical localities such heating serves two purposes. First, such heating dries the cement concrete base layer including removal of water which may be present in cracks. Second, heating of the cement concrete base layer in this manner assures that the thermoplastic sealant will penetrate fully into such cracks or other surface irregularities as may be present without being cooled and hardened, prior to full penetration, by contact with relatively cold concrete. In certain arid geographical regions such as deserts the cement concrete base layer may already be dry but deep heating is still needed for the second reason discussed above. The concrete heating step also promotes strong bonding between the sealant layer and the concrete base layer by preventing overly rapid cooling of the sealant material at the interface and still further facilitates a subsequent compaction step by assuring that the sealant layer remains in a softened condition for a period of time.

In accordance with the invention, the heating step is accomplished by directing microwave energy into the cement concrete base layer. This novel method of heating pavement has unique characteristics which cannot be duplicated by conventional pavement heating methods all of which apply heat in one form or the other to the surface of pavement and then rely on the slow process of heat transfer by conduction downwardly into the pavement. The conventional heating methods are not only far slower but also establish a very severe vertical temperature gradient in the concrete so that heating is highly non-uniform. As a practical matter the surface must be severely overheated in order to obtain a desired temperature at some specific depth in a reasonable period of time. Because of this inherent temperature gradient, using conventional methods of pavement heating, the rate at which heat energy can be applied to the concrete is itself limited by the need to avoid a damaging high temperature at the immediate surface of concrete. Microwave heating contrasts sharply with each of these characteristics of conventional forms of pavement heating.

Microwave energy, which is not itself heat, penetrates downwardly through the volume of concrete virtually instantaneously and then converts to heat energy inside the concrete through an electrical interaction with molecules of dielectric constituents of the concrete, most notably by interaction with rock aggregate molecules. Heating is therefore extremely rapid and it is relatively uniform. There is in fact a slightly inverted temperature gradient within the upper several centimeters of concrete which characteristic aids in promoting drying as will hereinafter be discussed in more detail. Because of the relatively uniform heating of the concrete, the rate at which energy can be transferred into the concrete is not limited by a need to avoid burning of the surface as opposed to other portions of the concrete.

Figure 3:
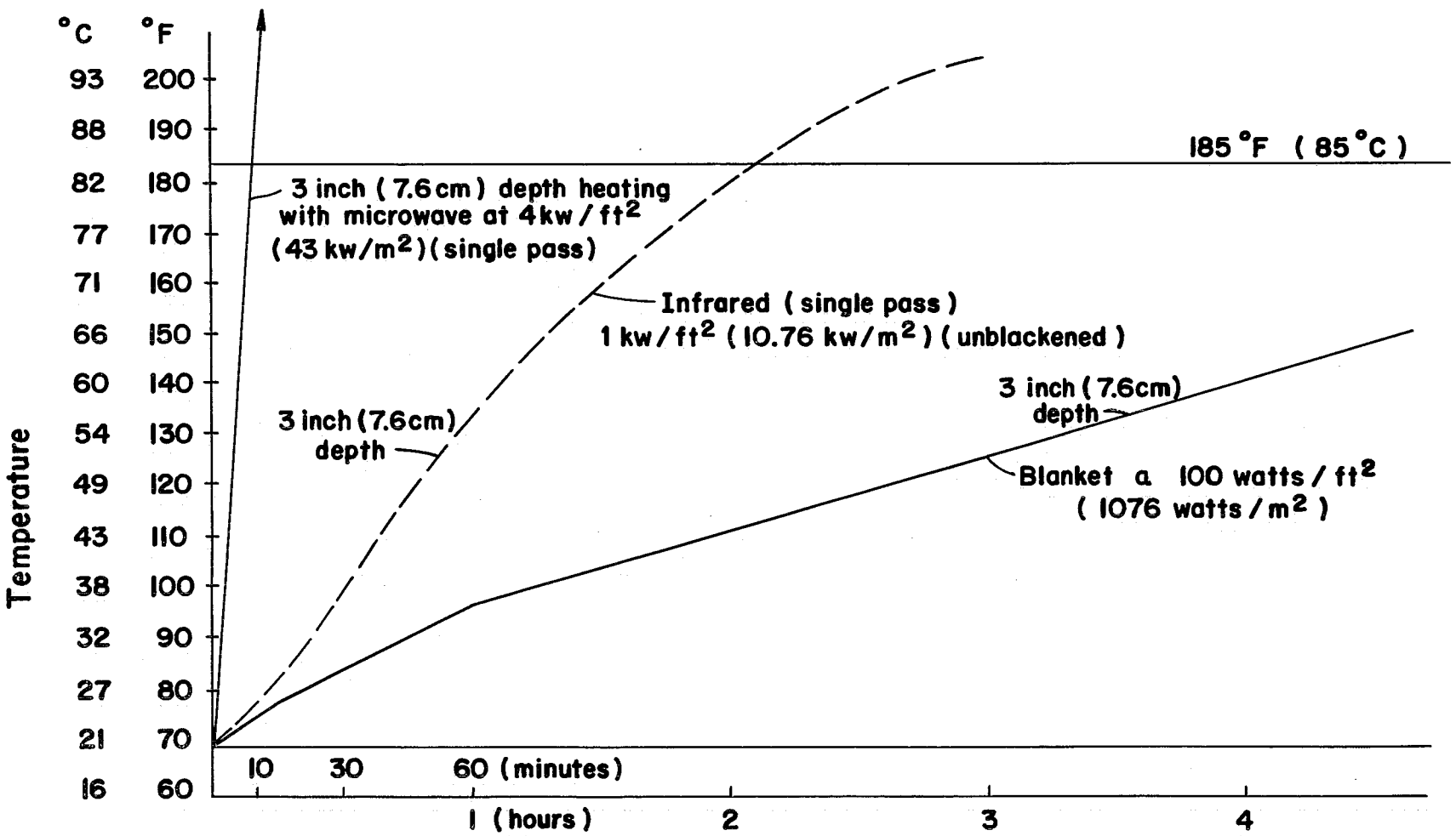
FIG. 3 is a graphical depiction of the rate of subsurface heating of concrete utilizing a microwave heating step in accordance with the present invention and, for purposes of comparison, also showing rates of subsurface heating utilizing conventional concrete heating techniques.

The extreme speed of heating of concrete with microwave energy is depicted graphically in FIG. 3 in which the temperature of concrete at a depth of three inches (8 cm) below the surface is shown as a function of time as determined from experimental data where a sample of Portland cement concrete was irradiated with microwave energy at a power input of 4 kw/sq. ft. (43 kw/m$^2$). For purposes of comparison FIG. 3 also shows the results of applying infrared heat to the concrete surface at a power input of 1000 watts per square foot (10.7 kw/m$^2$). As pavement heating has in some prior cases been accomplished by laying electrically heated blankets on the pavement surface, FIG. 3 also illustrates the rate of rise of temperature at a depth of three inches (7.6 cm) in the concrete when an electrically heated blanket was laid on the surface and operated to apply heat at a power level of 100 watts per sq. ft. (1076 w/cm$^2$). The concrete at a depth of three inches (7.6 cm) was heated by microwave energy to a temperature of about 185° F. (85° C.) in about 10 minutes. A comparable temperature at that depth was reached only after about two hours of the infrared heating. A comparable temperature at that depth was not reached at all using the electric blanket heating during the 4½-hour test period represented on the time scale of FIG. 3 although such temperature was eventually reached after about eight hours. It should be recognized that the sizably greater energy input per unit surface area that was employed with microwave as opposed to infrared heating and electric blanket heating, in the data of FIG. 2, is representative of the fact that much more intense energy inputs are practical when microwave energy is the heating medium. As previously discussed there are limitations to the rate at which it is practical to apply energy to the surface of concrete using the older conventional methods, the risk of overheating the immediate surface being one.

Figure 4:
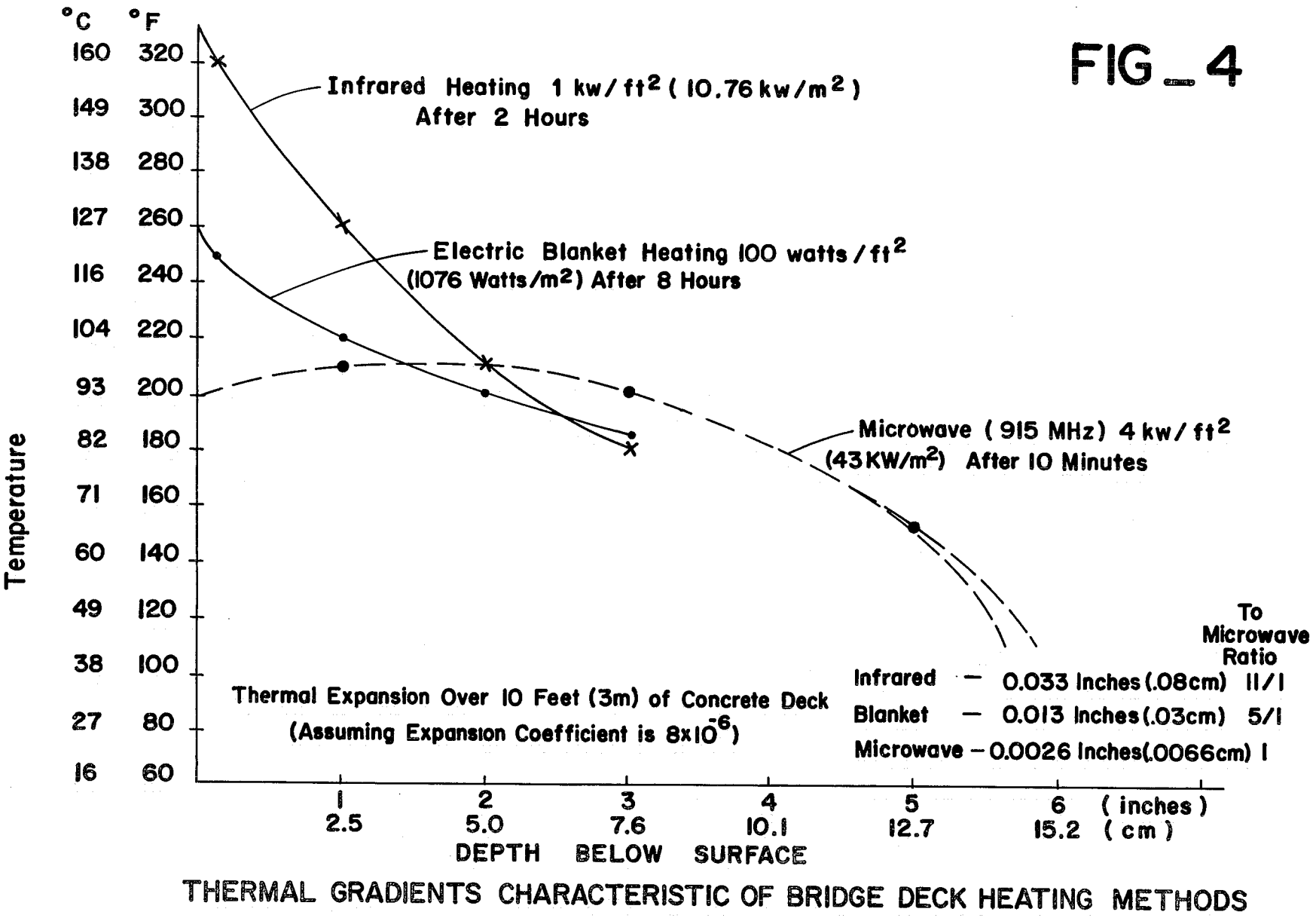
FIG. 4 is a graph depicting the vertical temperature gradient established within concrete heated by the microwave irradiation technique of the present invention and also showing, for purposes of comparison, the temperature gradients established in the concrete by conventional methods of pavement heating.

FIG. 4 depicts experimental data graphically illustrating the remarkably more uniform temperature gradient established within the concrete by the microwave heating as opposed to the infrared heating and the electric blanket heating. As illustrated by the dashed line of FIG. 4, the temperature of the concrete using microwave heating is everywhere within a range of about 190° F. to about 225° F. (88° C. to 107° C.) from the surface down to a depth exceeding four inches (10 cm) and falls off at a relatively gentle gradient thereafter. By contrast, when the concrete at a depth of three inches (7.6 cm) has been heated to 185° F. (85° C.) by infrared heat, the surface temperature exceeds 320° F. (160° C.). Also for purposes of comparison, when the concrete at a depth of three inches has been heated to about 190° F. (88° C.) by electric blanket heating, the surface temperature is about 260° F. (127° C.).

Accordingly heating of the concrete base layer by microwave irradiation is far more rapid and far more uniform than in the case of heating pavement by prior techniques which require the direct application of heat as such to the surface of the concrete, and which must rely on heat conduction downwardly into the interior of the concrete.

As previously pointed out, the heating step also serves the purpose of assuring that the cement concrete is dry prior to the application of the additional layers of the composite pavement. The special properties of microwave heating may again be used to realize unique advantages in this connection. Heating of any kind promotes drying by accelerating the evaporation of water. The deep, rapid and relatively uniform heating accomplished by microwave energy promotes very rapid drying. Moreover, the inverted temperature gradient which is established in the upper portion of the concrete serves to further accelerate the migration of moisture to the surface. Water vapor pressures at various points within the heated concrete correlate with the temperature at those points. Thus the inverted temperature gradient evident in the dashed line of FIG. 4, down to a depth of about two inches (5 cm) in this instance, also gives rise to a vapor pressure gradient in which vapor pressure become progressively higher downward into the concrete for a significant distance thereby accelerating the movement of moisture vapor towards the surface.

Referring again to FIG. 2, the step of heating and drying the concrete base layer with microwave energy may be greatly facilitated by also applying a flow of hot gas to the surface of the base layer. The application of hot gas may in part precede the microwave heating or may be commenced at an intermediate time during microwave heating or thereafter.

To promote drying, it is most advantageous if some microwave heating precedes the hot gas application. The application of hot gas to the surface aids drying by accelerating the removal of water vapor which has diffused or migrated to the surface of the concrete and in addition contributes further to establishing a relatively uniform temperature gradient within the concrete. The above-discussed inverted temperature gradient in the upper region of concrete heated by microwave energy arises at least in part from the cooling effect of the evaporation of water which has been driven to the surface by the microwave heating. Owing to this evaporation heat loss, the immediate surface of the concrete may tend to be distinctly cooler than the underlying interior regions and the application of hot gas to the surface of the concrete may be used to counteract this effect to assure adequate heating of the immediate surface. However, by delaying the start of the hot gas application, the inverted temperature and vapor pressure gradient may be used to drive moisture towards the surface.

Figure 5:
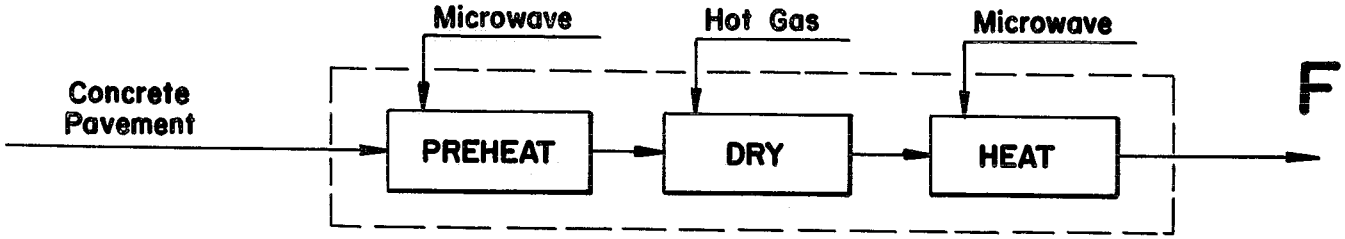
FIG. 5 is a schematic flow sheet illustrating an advantageous modification of the concrete heating and drying step of the method of FIG. 2.

While a single-stage microwave and hot gas heating step may be employed as depicted in FIG. 2, in many instances the period required to heat the cement concrete base layer to a temperature suitable for applying the thermoplastic sealant layer is less than the period required to accomplish drying. Typically, microwave heating to the desired temperature can be accomplished in periods of the order of 5 to 10 minutes but a somewhat longer period may be required for moisture to diffuse through the concrete and be removed by the hot gas. Under such circumstances the single heating stage and drying step of FIG. 2 may be replaced with a staged or sequential series of microwave heatings and hot gas treatments as depicted in FIG. 5. An initial pre-heating step by microwave energy may be employed to heat the concrete in depth to temperatures typically within the range of about 110° F. to about 160° F. (43° C. to 71° C.). Thereafter hot gas having a temperature in the range from about 200° F. (93° C.) to about 400° F. (204° C.) may be applied to the surface of the cement concrete for a period typically ranging up to about one hour. Thereafter an additional microwave heating step may be employed to further raise the temperature of the concrete to a temperature within the range from about 170° F. to about 284° F. (77° C. to 140° C.) in preparation for the application of the thermoplastic sealant layer. Alternately the hot gas step may overlap in time either or both of the microwave heating steps.

In many instances electrical power for operating microwave sources is not available at the worksite and one or more motor generator sets of the kind having a fuel-consuming engine driving a generator are used to produce the electrical power. Substantial cost economies and fuel savings in the practice of the invention may be realized by using the hot exhaust gases of the engine which drives the generator as a source of hot gas for the steps described above. The need to burn additional fuel to produce hot gas may then be avoided at least in part.

Referring again to FIG. 2, following the heating and drying of the cement concrete base layer, the intermediate layer of thermoplastic sealant is applied to the surface of the base layer while it is still in the heated condition. The sealant material may be asphalt or other thermoplastic compositions which harden, upon cooling, into a water-impervious solid, examples of which have been previously discussed. The deeply heated condition of the concrete base layer causes the sealant material to flow readily into cracks and other surface irregularities in the base layer so that the base layer is effectively and thoroughly sealed against water intrusion after hardening of the sealant material by cooling. In some instances application of the thermoplastic sealant layer may be followed by light rolling after partial hardening of the sealant material but this is not needed in many other instances particularly where the overlayer of asphaltic concrete hot mix is promptly applied and compacted.

Following application of the sealant layer the asphaltic concrete overlayer is applied to the surface of the sealant layer and the composite pavement is compacted with a roller, tamping means or the like. The asphaltic concrete overlayer may typically have a vertical thickness from about 1 inch (2 cm) to about 3½ inches (9 cm) although other thicknesses may be preferred in some circumstances. The asphaltic concrete overlayer may be formed by laying conventional new asphalt hot mix or, alternately, by depositing a layer of old asphalt pavement chunks recovered from a dumpsite or the like on the sealant layer and then decomposing, remixing and recompacting the old asphaltic concrete in place on the roadbed as described in the aboveidentified copending application Ser. No. 756,365.

The above-described method for forming a resealed and resealble composite pavement, starting with a cement concrete pavement, can be practiced if desired on a batch process basis at successive fixed areas of the cement concrete pavement. It is often more advantageous to utilize the method on a continuous process basis by simultaneously performing one or more of the several steps while traveling along a cement concrete pavement such as a roadway, bridge deck or the like. This not only accomplishes the formation of the composite pavement more rapidly but also avoids the problems of weak bonding in the boundary zones between areas of pavement which were laid at different times on a batch basis.

Apparatus suitable for performing the above-described method is disclosed in the above-identified copending application Ser. No. 756,365. A modification of such apparatus, specifically designed for the practice of the method of the present invention on a continuous process basis, is depicted in FIG. 6.

Figure 6:
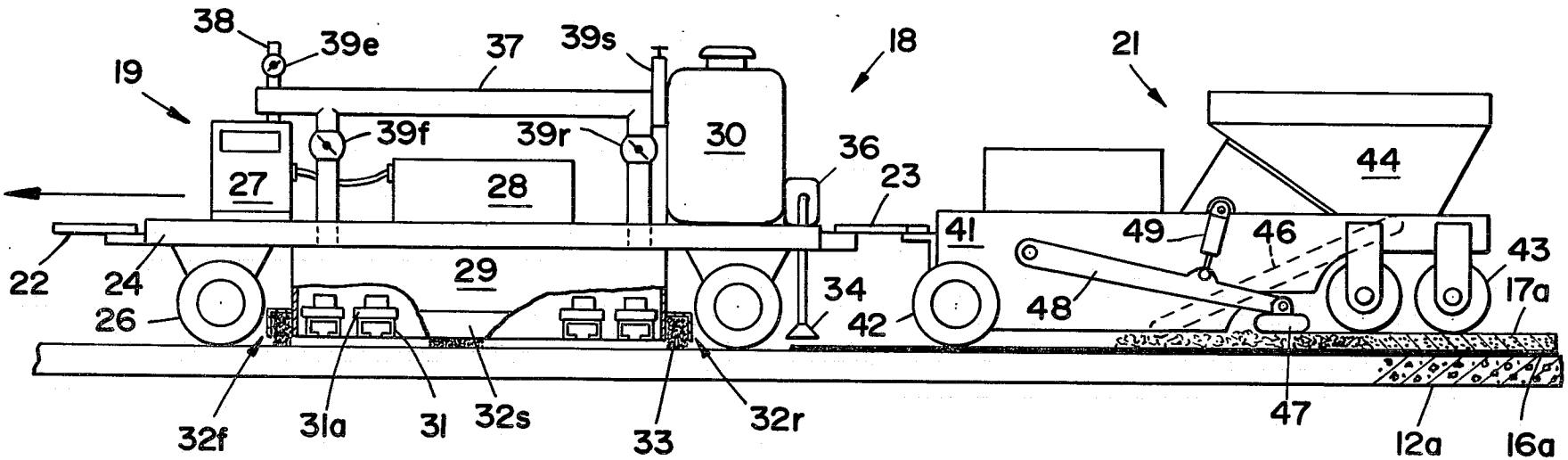
FIG. 6 is a broken-out elevation view of apparatus suitable for accomplishing the method of FIGS. 2 and 5 on a continuous process basis while traveling down a roadway, bridge deck or the like, FIG. 7 is a schematic flow sheet illustrating steps in a method for resealing and resurfacing of composite pavement of the form depicted in FIG. 1 after an interval of time during which deterioration may have occurred.

With reference to FIG. 6, the pavement processing apparatus 18 may include a microwave applicator vehicle 19 and an asphalt concrete paver vehicle 21 which follows closely behind vehicle 19. Although either or both of the vehicles 19 and 21 may be provided with a driving engine and drive system of a suitable known form in order to be selfpropelled, vehicle 19 in this example has a towing hitch 22 so that it may be drawn along the cement concrete roadway, bridge deck or the like 12*a* at a slow rate of speed by a truck, tractor or the like. The paver vehicle 21 is coupled to the back end of the microwave applicator vehicle 19 by another towing hitch 23.

The microwave applicator vehicle 19 may have a frame platform 24 riding on roadwheels 26 at both the front and back ends of the frame and carries one or more electrical motor generator sets 27 of the known form which produce electrical power by burning diesel fuel, gasoline or the like in a fuel-consuming engine. Also carried on the frame 24 is an insulated heated tank 30 for carrying liquefied sealant layer material such as asphalt or the like and a microwave generator power supply 28 which may be of known form and which is operated with electrical power from the motor generator set 27. A rectangular microwave applicator housing 29 is carried on vehicle 19 at the underside of frame 24 and extends downwardly towards the upper surface of the underlying concrete pavement 12*a*. The open lower end of housing 29 is spaced a small distance above the surface of the concrete to provide a small gap between the housing and the concrete for enabling travel of the vehicle without abrasion and interference.

To direct microwave energy downwardly into the underlying pavement 12*a*, a series of long waveguides 31 are supported within the lower portion of housing 29 and extend transversely relative to the direction of travel of the vehicle. Each waveguide 31 may be of the form known as leaky waveguides which have one or more slot openings in the underside, through which microwave energy is radiated downwardly, a leaky waveguide of this kind being disclosed in prior U.S. Pat. No. 3,263,052. Each of the waveguides 31 is excited by a magnetron tube 31*a* or other suitable microwave generator which may be mounted on one end of the waveguide and which is electrically coupled to power supply 28.

In the present example, four transverse waveguides 31 are present in the lower portion of applicator housing 29 with an initial closely spaced pair of the waveguides being within the forward portion of the housing while another closely spaced pair are at the rear portion of the housing and separated from forward pair by a sizable gap. As hot gas is supplied to housing 29 as will hereinafter be described in more detail, this spacing of the waveguides 31 enables the vehicle 19 to perform the staged preheating by microwave energy, followed by a period of hot gas drying, followed by additional microwave heating, as previously described with reference to FIG. 5, at each successive portion of the pavement 12*a* as the vehicle 19 is slowly and continuously traveled along the pavement.

To prevent the escape and broadcasting of undesirable amounts of microwave energy from the apparatus, housing 29 including all four sides and the top is formed of electrically conductive metal that has no openings with dimensions larger than a small fraction of the microwave wavelength. As an electrically conductive wall of this kind reflects microwave energy, the housing 29 prevents release of such energy in the upward and sideward directions except at the small gap between the lower edge of the housing walls and the underlying pavement. Energy which propagates downward is absorbed and attenuated in the pavement itself by being converted to heat energy primiarily within the rock aggregate which is the major constituent of concrete. While the gap between the lower edges of housing 29 and the pavement can usually be made smaller than about $\frac{1}{8}$ of the microwave wavelength in the vertical direction, it is longer than the wavelength in the horizontal direction and microwave trapping structures are therefore needed to prevent an unacceptably high release of microwave energy at the gap if the applicator vehicle is to be operated while traveling along the pavement. For this purpose one or more of the traveling microwave trapping structures 32 disclosed in the above-identified copending application Ser. No. 756,365 may be secured to the lower portion of the housing 29. In this example the microwave trapping structures 32 are of the chain trap form containing a mass of short lengths of electrically conductive metallic chain 33 that extend downward from the outer edge of the housing 29 and drag along the surface of the underlying pavement 12*a*. As the openings or interstices within such a mass of chain constitute passages having transverse dimensions much smaller than the microwave wavelength, microwave energy is unable to propagate through the mass. Thus the release of significant amounts of energy at the gap between the underside of the housing and the pavement is suppressed without impeding travel of the vehicle 19 along the pavement. The trapping structures 32 include chain traps 32*f* and 32*r* at the front and rear faces of the housing 29 and side traps 32*s* extending along both sides of the housing to form a flexible microwave barrier around all portions of the gap between the housing and the pavement.

To apply the intermediate thermoplastic sealant layer 16*a* to the base layer 12*a* of the concrete following the microwave heating and drying, applicator vehicle 19 also carries downwardly directed spray nozzles 34 situated behind the microwave housing 29 and which may be supplied with hot liquefied sealant material such as asphalt or the like by a pump 36 which draws the liquid from insulated tank 30.

Substantial cost economies can be realized by using the hot exhaust gases of the motor generator set 27 to provide the hot gas flow within housing 29. A diesel or gasoline engine or the like as used in a motor generator set typically dissipates around 70% of the energy content of consumed fuel as waste heat. Much of this otherwise wasted heat energy is recovered and usefully utilized in the vehicle 19, by means of an insulated gas conduit 37 which receives hot exhaust gas from the exhaust pipe 38 of the motor generator set and then transmits such gas into the front and rear portions of microwave housing 29 through flow control valves 39*f* and 39*r* respectively. Another portion of the hot exhaust gas may be transmitted to sealant tank 27 through another flow control valve 39s to maintain the sealant in liquefied condition. Portions of the hot exhaust that may not be needed for these purposes may be vented to atmosphere through an exhaust flow control valve 39e.

The paver vehicle 21 which follows vehicle 19 may have an inverted boxlike frame 41 supported at the front by road wheels 42 and supported at the rear by one or more compactor rollers 43 which may if desired be of the vibratory type. In instances where it is desired to compact the intermediate sealant layer 16a prior to deposition of the hot mix for the asphaltic concrete overlayer 17a, the front road wheels 42 of paver vehicle 21 may be replaced with another such compactor roller.

In contrast to prior paver vehicles, the hopper 44 for receiving and carrying the asphaltic concrete hot mix is preferably disposed at the back of the vehicle 21. In prior paver vehicles, the hot mix receiving means is generally situated at the front so that hot mix may be delivered by dump trucks which are driven up in front of the vehicle on the as yet unsurfaced roadbed. In most cases of the practice of the present invention that mode of loading is relatively less desirable as opposed to loading from the rear. In the present method, the speed of travel of the apparatus 18 along a roadbed, bridge deck or the like may be very slow, for example in a range of about 10 to 30 feet (3 m to 9 m) per hour. If the paving and compacting vehicle 21 is spaced rearwardly from the microwave applicator vehicle 19 a distance sufficient to admit trucks at the front of the paver vehicle, intervals of as much as two to six hours would elapse between the final microwave heating step and the deposition of the asphaltic concrete overlayer 17a. Under most conditions an undesirable amount of cooling of the concrete base layer 12a and intermediate sealant layer 16a might then occur prior to the final steps of the method. While this cooling can be counteracted by employing additional heating, through the use of insulative shrouds or other means, it is advantageous in many cases to situate the paver vehicle 21 very close to the back of the microwave applicator vehicle 19 and then to load asphalt hot mix into the hopper 44 from the rear of the paver vehicle. As may be recognized, it is also possible to load from the front and to carry the hot mix rearwardly to hopper 44 across microwave applicator vehicle 19 by utilizing lengthy conveyors but this requires considerable mechanical complication of the system.

Conveyor means 46 of suitable known form is provided within frame 41 to carry asphaltic concrete hot mix downward and forward from hopper 44 and to deposit the hot mix in a layer on top of the thermoplastic sealant layer 16a as the vehicle travels along the roadway. To grade and tamp the hot mix, a screed 47 extends transversely beneath the vehicle behind the forward end of conveyor means 46. Screed 47 is coupled to the frame of the vehicle through pivotable draft arms 48 which may be selectively raised or lowered, to position the screed vertically, by means of hydraulic actuators 49 connected between the draft arms and the frame of the vehicle. The screed 47, like the previously described final compactor rollers 43, may be of the known vibratory form if desired.

The end product of the above-described method and apparatus is a composite pavement smoothly surfaced and sealed against water intrusion. Like any other pavement, deterioration in the form of cracking, rutting or the development of surface irregularities of various other forms will occur over a period of time and significant water penetration may reappear. Repeated freezing and thawing of accumulated water in the cracks then tends to aggravate and extend the deterioration. The period of time which elapses before significant deterioration occurs is variable depending on such factors as climatic conditions, intensity and nature of use of the pavement, quality of the original paving materials and the like, but may typically range from a few years to many years. Unlike conventional pavements, the composite pavement of the present invention may very quickly, easily and economically be resealed and resurfaced using little or no additional materials.

Figure 7:
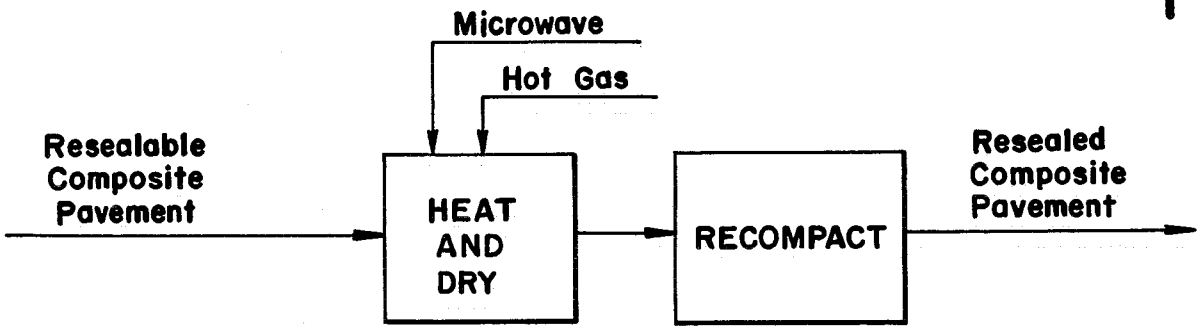

Restoration by resealing and resurfacing the composite pavement may be accomplished as depicted in FIG. 7. In particular, the deteriorated resealable composite pavement is again deeply heated and dried by irradiation with microwave energy and preferably by also subjecting the surface of the pavement to a hot gas flow in the manner previously described. The microwave irradiation heats not only the asphalt concrete overlayer and intermediate thermoplastic sealant layer but also at least an upper portion of the cement concrete base layer. The heating is continued until a temperature is reached at which the intermediate sealant layer again becomes liquid or semi-liquid and the asphaltic concrete overlayer is either decomposed by liquefaction of the asphalt binder or is at least softened. Heating is typically to temperatures in the range from about 170° to 284° F. (77° C. to 140° C.) at the upper region of the cement concrete base layer 12a, depending on the melting point of the sealant layer material. The reliquefied sealant layer material then flows into any new cracks or other voids which may have developed in the base layer of cement concrete and into any extensions of old cracks which may be present, this penetration being aided by the heated condition of the cement concrete of the base layer.

The composite pavement is then resurfaced by again compacting the pavement with a roller or tamping means while the sealant layer and the asphalt concrete layer are still in the heated condition. In addition to providing a compacted, smooth-surfaced pavement, the recompaction further aids penetration of the sealant into cracks. The result is a resealed, resurfaced composite pavement.

The above-described resealing and restoration process may be performed repeatedly at intervals following further recurrences of pavement deterioration.

The foregoing resealing and resurfacing method may be performed using the apparatus previously described with reference to FIG. 6 by inactivating the sealant layer depositing means and asphaltic concrete overlayer depositing means of the apparatus, although other equipment such as systems disclosed in copending application Ser. No. 756,365 may also be used. Alternately, the microwave applicator vehicle 19 may be used alone for this purpose, without paver vehicle 21, if it is closely followed by a conventional roller compactor vehicle or the like.

Figure 8:
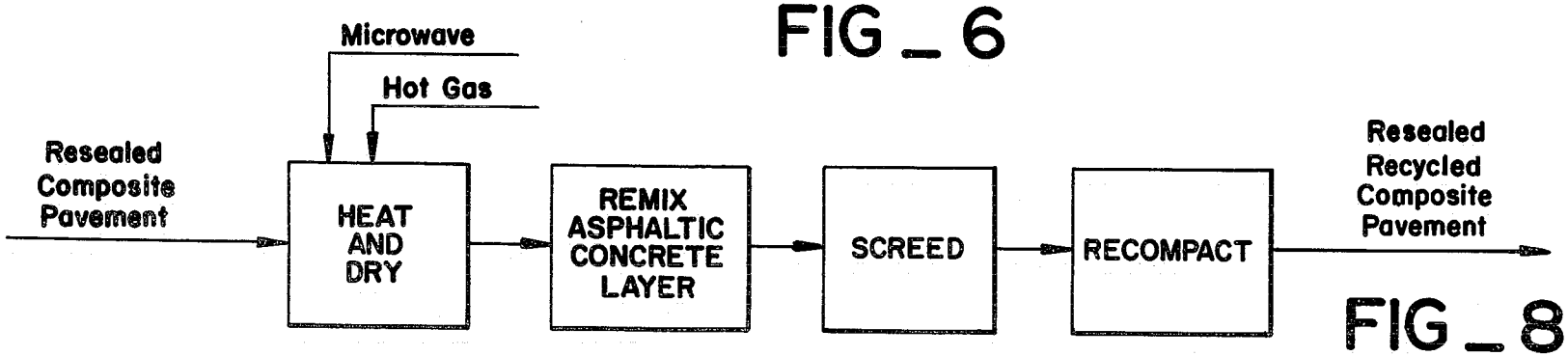
FIG. 8 is a schematic flow sheet illustrating an alternate method for restoring a composite pavement, of the form shown in FIG. 1, where deterioration is more severe.

Under conditions where deterioration of the asphalt concrete overlayer is unusually severe, a more extensive restoration method may be employed as depicted in FIG. 8. The method is similar to that of FIG. 7 except that additional steps are performed between the first (heating and drying) step and the final (compaction) step. In particular, following the heating and drying step and while the asphaltic concrete overlayer remains in a heated decomposed condition, the constituents of the overlayer are remixed by tilling, scarifying, raking or a combination of such remixing processes. Pavement conditioners or additional hot mix may be added at that time if desired but are unnecessary in many cases. The hot remixed asphaltic concrete constituents are then rescreeded, after which the composite pavement is recompacted.

While the invention has been described with respect to certain specific embodiments, many modifications are possible and it is not intended to limit the invention except as defined in the following claims.

What is claimed is:

1. A method for sealing cement concrete pavement comprising the steps:

directing microwave energy into said cement concrete pavement to generate heat within sub-surface regions of said concrete pavement, applying a layer of thermoplastic sealant to the surface of said heated cement concrete pavement, said sealant being temporarily in a hot, at least semi-liquid condition while in contact with said heated cement concrete pavement, applying an overlayer of asphaltic concrete on said sealant layer, and compacting said overlayer of asphaltic concrete and said sealant layer against said concrete pavement while still in a heated condition to produce a sealed composite pavement which may be resealed at a later time by a repeated heating and recompaction.

2. The method of claim 1 further comprising the step of directing hot gas to said surface of said cement concrete pavement prior to said application of said sealant layer thereto to supplement the heating effect of said microwave energy.

3. The method of claim 2 wherein said steps of directing microwave energy into said cement concrete pavement and directing hot gas to said surface thereof are at least in part performed simultaneously.

4. The method of claim 2 wherein said steps of directing microwave energy into said cement concrete pavement and of directing hot gas to said surface thereof are performed by pre-heating said cement concrete pavement with microwave energy followed by a period of said directing of hot gas to said surface of said cement concrete pavement, followed by further heating of said cement concrete pavement with additional microwave energy prior to said application of said sealant layer thereto.

5. The method of claim 2 comprising the further steps of producing said microwave energy with electrical power obtained by operating a motor-generator set which has a fuel-burning engine, and utilizing the exhaust gas of said engine as said hot gas which is applied to said surface of said cement concrete.

6. The method of claim 1 wherein said step of applying an overlayer of asphaltic concrete further comprises applying an asphaltic concrete overlayer having a softening temperature higher than the softening temperature of said sealant layer.

7. The method of claim 1 further comprising traveling along said cement concrete pavement while simultaneously performing each of said steps at successive portions thereof.

8. The method of claim 1 wherein said step of directing microwave energy into said cement concrete pavement further comprises heating said cement concrete pavement to a depth of at least about three inches (7 cm) to a temperature within the range from about 170° F. to about 284° F. (77° C. to 140° C.) prior to applying said thermoplastic sealant layer thereto.

9. The method of claim 1 further comprising the step of directing hot gas having a temperature within the range from about 150° F. to about 400° F. (66° C. to 204° C.) to said surface of said cement concrete pavement at least after initial microwave heating thereof and prior to said application of said sealant layer thereto.

10. The method of claim 9 further comprising applying said hot gas to said surface of said cement concrete pavement for a period from about 10 minutes to about 60 minutes after initiation of said microwave heating thereof and prior to said application of said sealant layer thereto.

11. The method of claim 1 further comprising the steps of pre-heating said cement concrete pavement to a depth of at least about three inches (7 cm) to a temperature within the range from about 110° F. to about 160° F. (43° C. to 71° C.) by directing microwave energy into said cement concrete pavement, directing hot gas having a temperature within the range from about 150° F. to about 400° F. (66° C. to 204° C.) to said surface of said cement concrete pavement after initiation of said pre-heating thereof and prior to said application of said sealant layer thereto, and further heating said cement concrete pavement with additional microwave energy to a temperature within the range from about 170° F. to about 284° F. (77° C. to 140° C.) prior to said application of said sealant layer thereto.

12. The method of claim 1 further comprising resealing and resetting said composite pavement after a period of time and after partial deterioration thereof by the steps comprising:

redirecting microwave energy into said composite pavement to reheat said asphaltic concrete overlayer and said thermoplastic sealant layer and at least an upper portion of said cement concrete, and recompacting said composite pavement while in the reheated state.

13. The method of claim 12 comprising the further step of directing hot gas to the surface of said asphaltic concrete overlayer prior to said recompaction of said composite pavement.

14. The method of claim 12 wherein said step of redirecting microwave energy into said composite pavement further comprises heating said sealant layer and said asphaltic concrete overlayer and at least an upper portion of said cement concrete pavement to a temperature within the range from about 170° F. to about 284° F. (77° C. to 140° C.).

15. The method of claim 12 comprising the further steps of:

remixing the constituents of said asphaltic concrete overlayer following said reheating with microwave energy and prior to said recompaction of said composite pavement, and screeding said remixed asphaltic concrete overlayer prior to said recompaction of said composite pavement.

16. A method for resealing and resurfacing a deteriorated composite pavement which has a base layer of cement concrete, an intermediate layer of thermoplastic sealant material and an overlayer of asphaltic concrete comprising:

directing microwave energy into said composite pavement to generate heat simultaneously within said asphaltic concrete overlayer and said thermoplastic sealant layer and at least an upper portion of said base layer of cement concrete, and recompacting said composite pavement while in the heated state.

17. The method of claim 16 comprising the further step of directing hot gas to the surface of said asphaltic concrete overlayer prior to said recompaction of said composite pavement.

18. The method of claim 16 wherein said step of directing microwave energy into said composite pavement further comprises heating said sealant layer and said asphaltic concrete overlayer and at least an upper portion of said cement concrete pavement to a temperature within the range from about 170° F. to about 284° F. (77° C. to 140° C.).

19. The method of claim 6 comprising the further steps of:

remixing the constituents of said asphaltic concrete overlayer following said heating with microwave energy and prior to said recompaction of said composite pavement, and screeding said remixed asphaltic concrete overlayer prior to said recompaction of said composite pavement.

* * * * *

UNITED STATES PATENT OFFICE

CERTIFICATE OF CORRECTION

Patent No. 4,175,885 Dated November 27, 1979

Inventor(s) Morris R. Jeppson

It is certified that error appears in the above-identified patent and that said Letters Patent are hereby corrected as shown below:

| | |
|---|---|
| Col. 6, line 28 | "w/cm$^2$" should be --w/m$^2$-- |
| Col. 1, line 16 | "resotration" should be --restoration-- |
| Col. 1, line 54 | "conrete" should be --concrete-- |
| Col. 2, line 19 | "tha" should be --that-- |
| Col. 8, line 56 | "aboveidentified" should be --above identified-- |
| Col. 8, line 59 | "resealble" should be --resealable-- |
| Col. 10, line 15 | "primiarily" should be --primarily-- |
| Col. 16, line 3 | "6" should be --16-- |

Signed and Sealed this

*Seventeenth* Day of *June 1980*

[SEAL]

*Attest:*

SIDNEY A. DIAMOND

*Attesting Officer* *Commissioner of Patents and Trademarks*